United States Patent [19]

Sacks

[11] Patent Number: 5,033,360

[45] Date of Patent: Jul. 23, 1991

[54] AIR QUALITY CONTROL SYSTEM

[76] Inventor: Charles H. Sacks, c/o Hallandale Rehabilitation Center, 2400 E. Hallandale Beach Blvd., Hallandale, Fla. 33009

[21] Appl. No.: 415,057

[22] Filed: Sep. 29, 1989

[51] Int. Cl.[5] ..... F24F 12/00

[52] U.S. Cl. ..... 98/33.1; 98/42.03

[58] Field of Search ..... 98/33.1, 42.03; 169/60, 169/61, 91

[56] References Cited

U.S. PATENT DOCUMENTS

| | | | |
|---|---|---|---|
| 1,926,298 | 9/1933 | Moore | 98/42.03 X |
| 2,564,971 | 8/1951 | Harding | 98/42.03 |
| 3,294,480 | 12/1966 | Potapenko | 98/33.1 X |
| 3,396,652 | 8/1968 | Morrison et al. | 98/42.03 |
| 3,884,133 | 5/1975 | Miller | 98/42.03 X |
| 3,916,566 | 11/1975 | Lacombe | 98/42.03 X |
| 3,926,101 | 12/1975 | Moss | 98/42.03 X |
| 4,054,084 | 10/1977 | Palmer | 98/42.03 |
| 4,068,568 | 1/1978 | Moss | 98/42.03 X |

FOREIGN PATENT DOCUMENTS

| | | | |
|---|---|---|---|
| 639519 | 6/1950 | United Kingdom | 98/42.03 |

*Primary Examiner*—Harold Joyce

*Attorney, Agent, or Firm*—Herbert L. Lerner; Laurence A. Greenber

[57] ABSTRACT

An air quality control system for buildings with units, public corridors and an elevator shaft, has means for partitioning the public corridors into zones. Each of the zones have a first end in the vicinity of the partitioning means and a second end. Air inlet ducts are disposed in the vicinity of the second ends of the zones. Blower fans are disposed in the air inlet ducts for supplying fresh air to the zones. An exhaust duct communicates with the first ends of each of the zones for removing ambient air from the zones.

16 Claims, 4 Drawing Sheets

AIR QUALITY CONTROL SYSTEM

BACKGROUND OF THE INVENTION

1. Field of the Invention

The invention relates to an air quality control system, in particular to an air quality control system for public areas of multi-unit buildings. The invention may be used to ensure that paths of egress are smoke-free, especially in the case of an emergency. The invention thus helps reduce the risk of death due to smoke inhalation. The invention can further be utilized as an odor and/or heat control system.

2. Description of the Related Art

Hallways and other public areas of apartment buildings, hotels, office buildings, nursing homes, hospitals, and the like, i.e. public areas of multi-unit buildings, must remain smoke-free and cool in the case of fires, since they very often provide the only paths of egress to the emergency exits. Several methods and devices have been disclosed which deal with the problem.

One of the methods for controlling smoke is to increase the ambient pressure by supplying fresh air. A system utilizing this method is disclosed in U.S. Pat. No. 3,926,101 to Moss. A hallway, which is partitioned into three sections is subjected to increased air pressure, which is to keep the smoke coming from an apartment within that apartment. Since no exhaust vents are provided, the smoke which had entered the hallway, and thus had triggered the smoke alarm, either remains in that hallway or is distributed to other, adjacent apartment units.

Several other U.S. Patents, such as U.S. Pat. No. 3,884,133 to Miller and U.S. Pat. No. 2,564,971 to Harding relate to fire control systems, whose primary purpose is the control of fires in multi-unit buildings.

One problem with the prior art devices is that they do not provide a system for removing smoke and other poisonous gases from escape routes and for re-supplying fresh air. Furthermore, none of the known systems relate specifically to the problem of handicapped people, who usually cannot use the stairs and therefore depend on the elevators as the only possibility of escape.

The prior art devices are also inadequate for odor and heat control when there is no fire, because the existing air is not removed and replaced with fresh air.

SUMMARY OF THE INVENTION

It is accordingly an object of the invention to provide an air quality control system which overcomes the hereinafore-mentioned disadvantages of the heretofore-known devices of this general type and which ensures that public corridors and elevator shafts in public buildings remain free of smoke in the case of increased smoke production due to a fire in the building. Since the elevators are smoke-free, they may still be used in the case of an emergency. The system should also be able to control odor and heat when there is no fire.

Furthermore it overcomes the prior art, in particular U.S. Pat. No. 3,926,101 to Moss, which merely pressurizes the ambient air to keep smoke in the apartment. In contrast to Moss, the object of the invention is to remove smoke and unbreathable air from public areas and to supply a substantially equal amount of fresh air.

With the foregoing and other objects in view there is provided, in accordance with the invention, an air quality control system for buildings with units, a public corridor and an elevator shaft, comprising means for partitioning the public corridor into zones, the zones each having a first end in the vicinity of the partitioning means and a second end, air inlet ducts disposed in the vicinity of the second ends of each of the zones, blower fans disposed in the air inlet ducts for supplying fresh air to the zones, and an exhaust duct communicating with the first ends of each of the zones for removing air from the zones.

Air from the environment outside the building replaces ambient air on the inside of the building.

Since most fires are located within the private units of multi-unit buildings, it is advisable to use self-closing door mechanisms in connection with the invention. These may either be triggered by a smoke alarm or they may be spring-loaded closers which normally close doors, not only in the case of an emergency.

In accordance with an additional feature of the invention, the partitioning means are in the form of a door, which may be a two-panel door.

In accordance with a further feature of the invention, the air quality control system includes actuating means for operating the partitioning means. In accordance with an added feature, these actuating means are in the form of a closing motor.

In accordance with another feature of the invention, the air quality control system includes manually operable switches, which may be considered smoke alarm switches or merely switches for removing odor or heat, located in the zones and connected to the actuating means, the actuating means, or possibly the closing motor, being activated by the switches.

In accordance with an added feature of the invention, the air quality control system includes smoke detectors located in easily accessible locations throughout the zones, and the actuating means are activated by the smoke detectors.

In accordance with again another feature of the invention, the air quality control system includes booster vents disposed in the zones for increasing the amount of fresh air supplied to the zones, and booster fans located in the vents.

In accordance with again a further feature of the invention, the air quality control system includes exhaust vents located in the elevator shaft and the exhaust vents communicate with the exhaust duct.

In accordance with again an added feature of the invention, each of the air inlet ducts draws fresh air directly from the outside of the building.

In accordance with again an additional feature of the invention, the air quality control system includes a main air handler duct drawing fresh air from the outside of the building, and each of the air inlet ducts communicate with the main air handler duct.

In accordance with yet another feature of the invention, the air quality control system includes doors connecting the public corridor or corridors with the units of the multi-unit building, and the doors are equipped with means for automatically closing the doors.

In accordance with yet a further feature of the invention, an air quality control system for buildings with units, public corridors and an elevator shaft comprises means for partitioning the public corridors into zones, the zones each have a first end in the vicinity of the partitioning means and a second end, air inlet ducts disposed in the vicinity of the second ends of each of the zones, blower fans disposed in the air inlet ducts for supplying fresh air to the zones, and an exhaust duct communicating with each of the first ends of each of the zones for removing air from the zones.

In accordance with a concommitant feature of the invention, the location of the smoke exhaust and the air supply ducts may be reversed, so that fresh air is in effect supplied in the vicinity of the partitioning means and the exhaust is drawn off from the region of the second ends of the respective zones.

Other features which are considered as characteristic for the invention are set forth in the appended claims.

Although the invention is illustrated and described herein as embodied in an air quality control system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
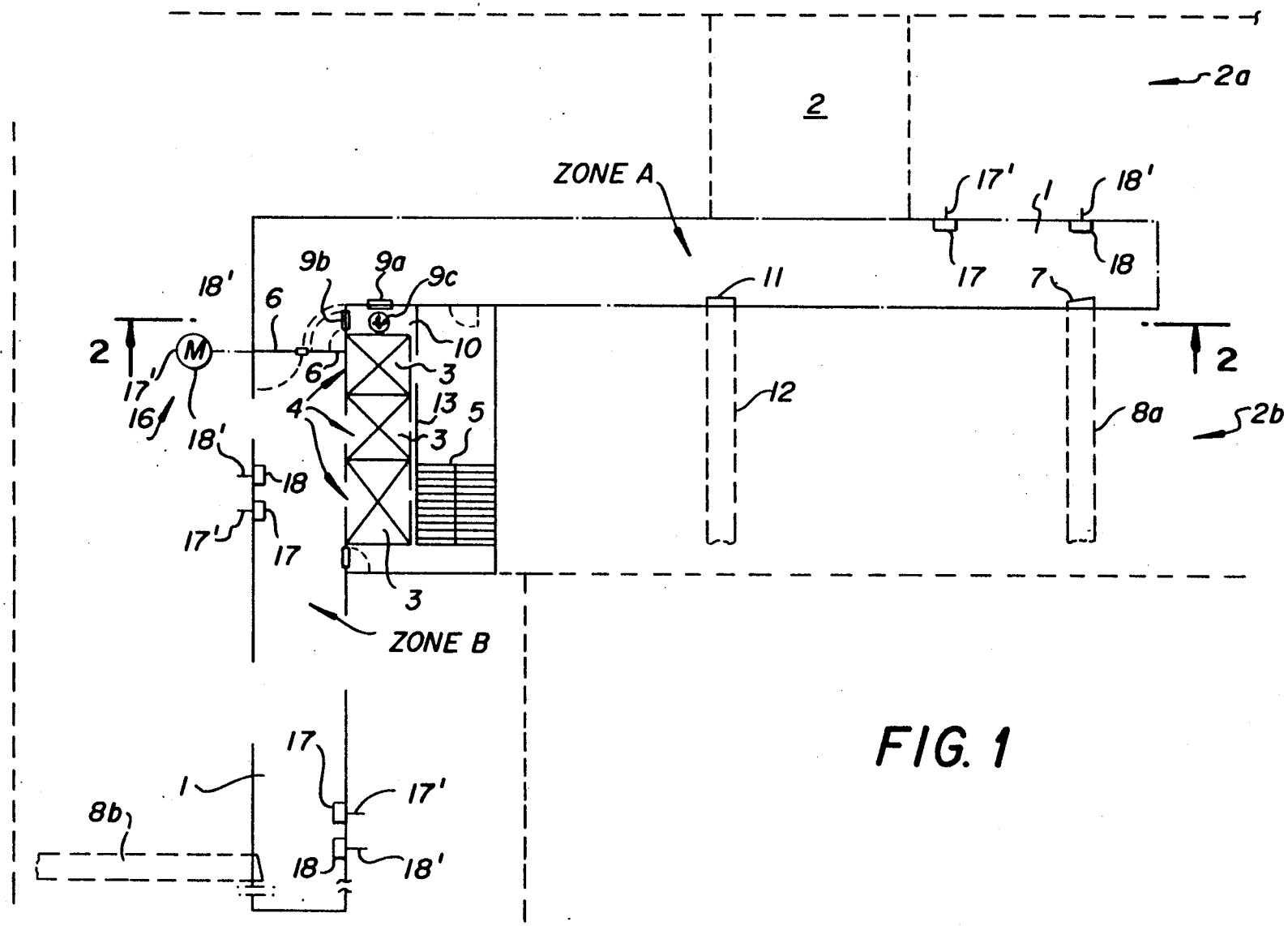
FIG. 1 is a fragmentary, diagrammatic, top-plan view of the "living level" of one wing of a U-shaped apartment building.

Referring now to the figures of the drawing in detail and first, particularly, to FIG. 1 thereof, there is seen a public corridor 1 of an apartment building. The corridor 1 shown is disposed centrally between two rows of apartments 2*a* and 2*b*. One of the apartments 2 is indicated with dashed lines.

Figure 1A:
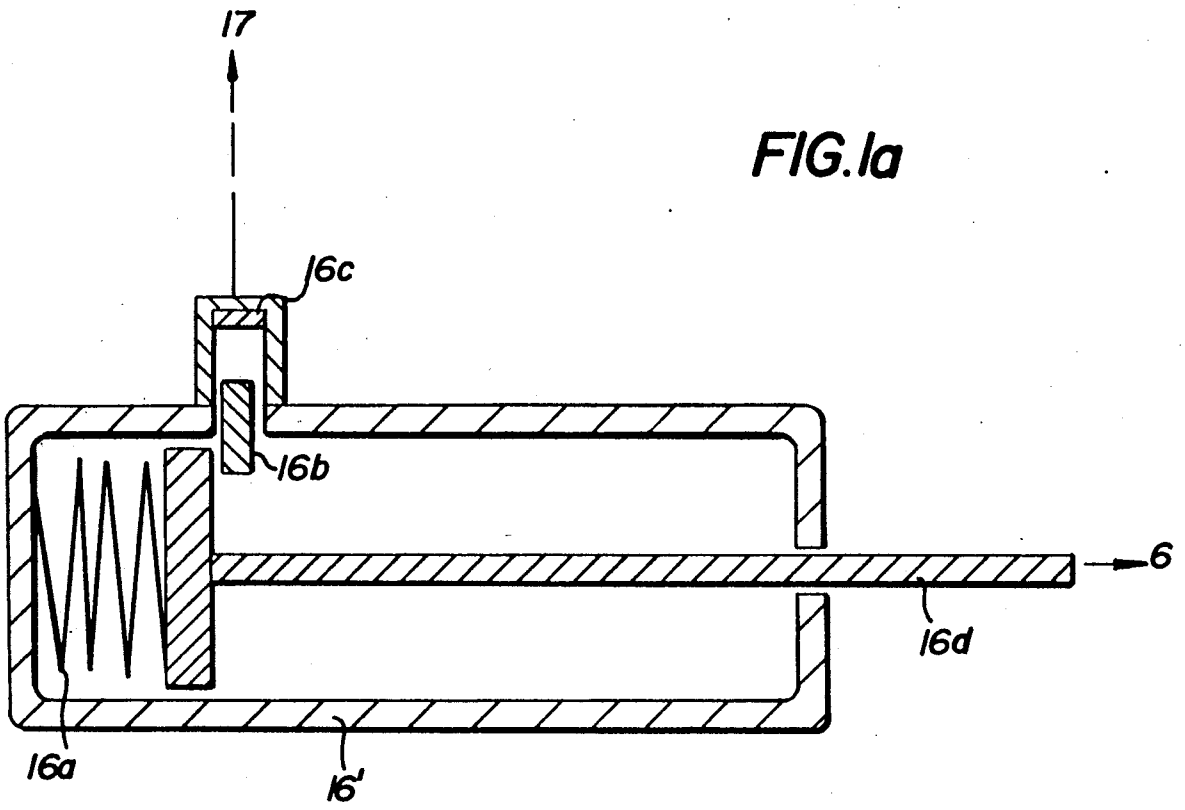
FIG. 1*a* is a fragmentary cross-sectional view of a servo mechanism.

The corridor 1 connects the apartment units 2 to an elevator and public stairway section, which is illustrated with three elevators 3 and an emergency staircase 5. The emergency staircase 5 is connected to the corridor 1 by two doors, one leading to each zone A and B of the corridor 1. A bi-sectional door 6 is provided for partitioning the corridor into the two zones A and B. While the doors 6 at the first ends of the zones A and B are normally open, they can be closed in the case of an emergency, and thus create the corridor zones A and B. The doors 6 are equipped with actuating means in the form of self-closing mechanisms 16, which may be triggered when one of several manually operable switches 17 is set off, or theY may be triggered automatically when one of several smoke detectors 18 is activated. The switches 17 may sound an alarm in case of fire, or they may be used to remove odor or heat without an alarm. The alarm 17 and detectors 18 are connected to motors M of the mechanisms 16 by respective lines 17', 18'. While each of the door panels is equipped with a motor M, only one such motor is illustrated in FIG. 1. FIG. 1*a* illustrates actuating means in the form of a servo mechanism 16' which closes a door 6 through the action of a spring 16*a* on a piston rod 16*d*, when a latch 16*b* is retracted by a magnret 16*c* connected to the switch 17.

An air control system is put into operation together with the closing of the doors 6. This system includes a blower fan 7 disposed in a wall or the ceiling of the public corridor 1. The fan 7 supplies fresh air from the outside through a wall duct 8*a*, 8*b* at the second end of the zones A, B. At the opposite end of the zone A in the corridor 1 from the fan 7, is an exhaust opening 9*a* leading into an exhaust duct 10, which is a section of the elevator shaft which houses the 3 elevators 4. The exhaust duct 10 leads to a non-illustrated outside ventilating unit. The exhaust opening 9*a* draws smoke or foul or hot air from the corridor zone A. An opening 9*b* is connected to a vent above the door 6 which is indicated with dashed lines, thus drawing air from the zone B. The operation of this air control system ensures that any smoke or poisonous gases present in the corridor 1 are drawn off through the exhaust vents 9*a* and 9*b* and fresh air is supplied from the fresh air inlet duct 8.

Not all of the elements of the air quality control system in accordance with the invention are illustrated for zone B. Without deviating from the spirit of the invention, the location of air inlet and air exhaust ducts respectively may be reversed. Accordingly, fresh air would be supplied to each of the zones A and B through the vents 9*a* and 9*b*, and the smoke would be drawn off through the duct 8*a* in zone A and the duct 8*b* in zone B.

In order to isolate the corridor 1 for better smoke control, all of the apartment doors should be equipped with selfclosing mechanisms, which may be hydraulic, pneumatic or simple spring-hinge door closers. This also ensures that any smoke which develops in an apartment, is retained in the apartment.

Should the corridor 1 be longer than a given length, a booster fan 11 and a fresh air inlet duct 12 may be added for better control of the air in the corridor 1. This additional duct 12 can easily be disposed behind kitchen cabinets, for instance, and thus not create an unnecessary demand for additional space. Additionally, the exhaust duct 10, which usually leads to the roof of the building, may be equipped with one or more booster fans in order to increase the volume of air handled per unit of time.

Any smoke present in the main elevator shafts 4 will be drawn off through a suction pipe 13 into the main exhaust duct 10. Accordingly, the elevator shafts will be free of smoke, and the elevators 4 can still be operated safely. The main reason for prohibiting use of elevators during fire is that the electric wiring and controls will be affected by the heat. With the ventilation described herein, that is not a problem.

Figure 2:
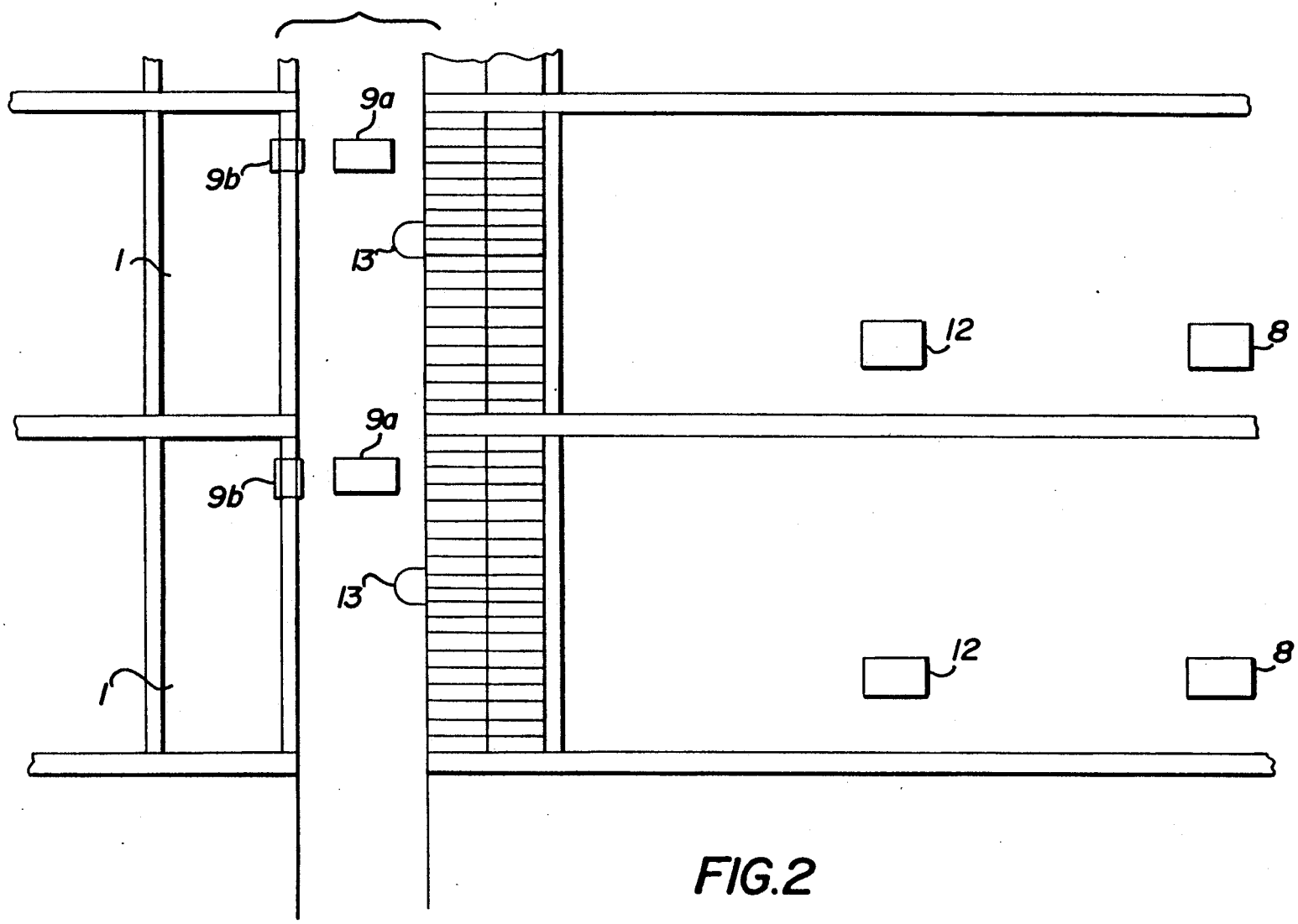
FIG. 2 is a fragmentary, vertical-sectional view through two stories of an apartment building, taken along the line II—II in FIG. 1, in the direction of the arrows.

As illustrated in FIG. 2, the fresh air intake ducts 8 and 12, and correspondingly the air supply fan 7 and the booster fan 11, are positioned close to the floors of the respective corridors 1. This ensures that, during heavy smoke production, at least the lower regions of the corridor will be free of smoke. The exhaust ducts 9*a* and 9*b* are located close to the ceilings of the respective corridors 1, where the heaviest smoke concentration occurs.

The suction ducts 13 illustrated in FIG. 2 may be disposed anywhere within the elevator shaft 4. The number of ducts 13 as well as their size can be adapted to the size of the elevator shaft 4.

A duplex-type apartment building disclosed in applicant's co-pending Application Ser. No. 329,767, filed Mar. 28, 1989, in which a Notice of Allowance was dated June 12, 1989, has sleeping levels without public corridors disposed directly above living levels with public corridors. The air quality control system can easily be adapted to this arrangement of alternating sleeping and living levels.

Figure 3:
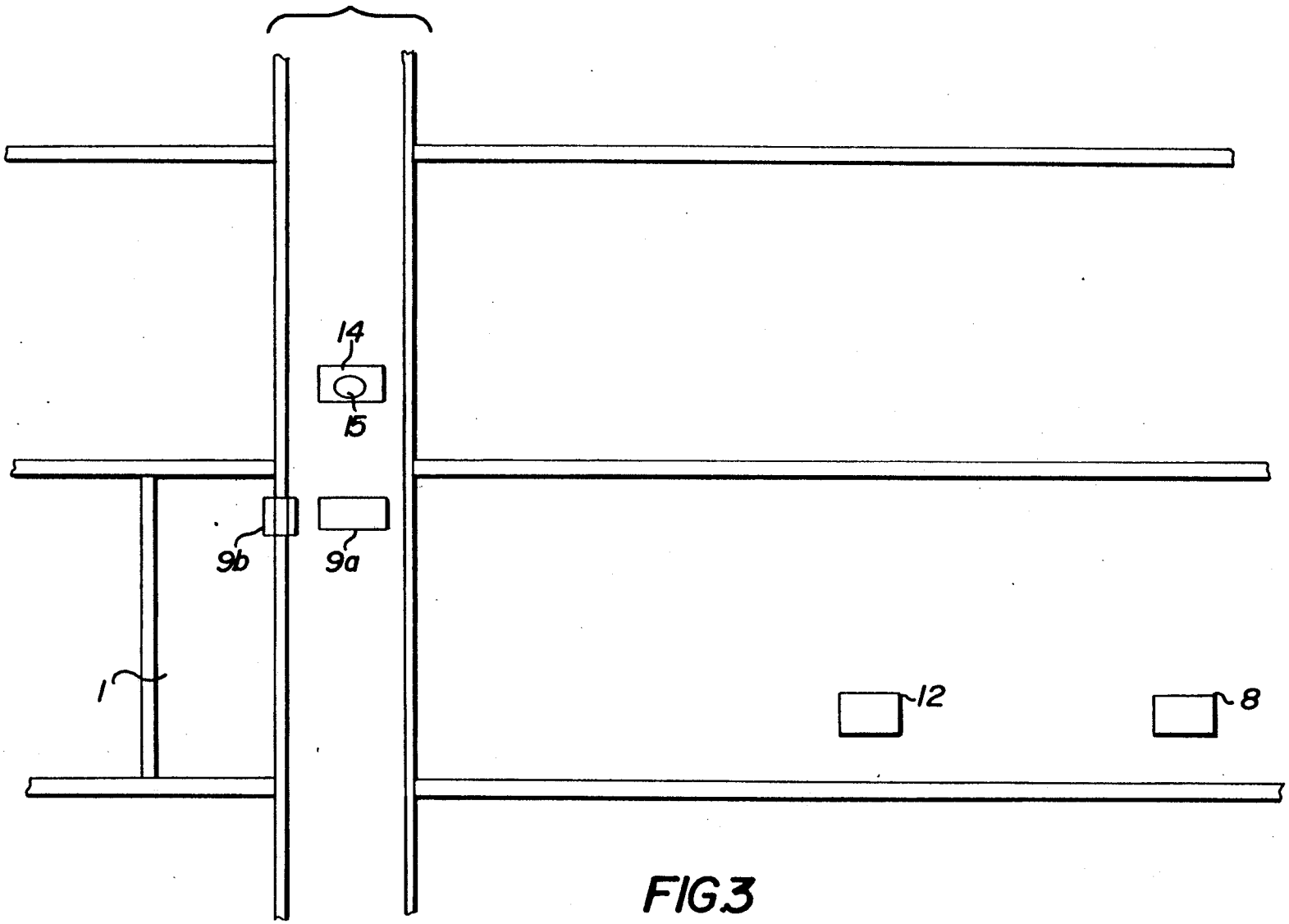
FIG. 3 is a fragmentary, vertical-sectional view through two stories of a duplex-type apartment building, taken along the line II—II in FIG. 1.

The lower level shown in FIG. 3, which is a living level, is identical to the levels shown in FIG. 2, with a public corridor 1, fresh air supply ducts 8 and 12 and smoke exhaust ducts 9*a* and 9*b*. The upper level of FIG. 3 is a sleeping level without a corridor. Accordingly, there is no need for an air quality control system for a corridor. However, fresh air is supplied to the elevator shaft through a fresh air duct 14. The duct 14 shown in FIG. 3 is equipped with a booster fan 15. Tall apartment buildings with long elevator shafts require booster fans, which are advantageously disposed within the fresh air ducts.

I claim:

1. Air quality control system for buildings with units, a public corridor and an elevator shaft, comprising means for partitioning the public corridor into zones, and zones each having a first end in the vicinity of said partitioning means and a second end, air inlet ducts disposed in the vicinity of said second ends of each of said zones, blower fans disposed in said air inlet ducts for supplying fresh air to said zones, an exhaust duct communicating with said first ends of each of said zones for removing air from said zones, and means for directing an air flow from said air inlet ducts into the corridor and out of the corridor through said exhaust duct in dependence on the air quality in the corridor.

2. Air quality control system according to claim 1, wherein said partitioning means are in the form of a door.

3. Air quality control system according to claim 2, wherein said door is in the form of a two-panel door.

4. Air quality control system according to claim 1, including actuating means for operating said partitioning means.

5. Air quality control system according to claim 4, wherein said actuating means is in the form of a closing motor.

6. Air quality control system according to claim 4, including manually operable switches located in said zones and connected to said actuating means, said actuating means being activated by said switches.

7. Air quality control system according to claim 4, including smoke detectors located in easily accessible locations throughout said zones, and said actuating means being activated by said smoke detectors.

8. Air quality control system according to claim 1, including booster vents disposed in said zones for increasing the amount of fresh air supplied to said zones, and booster fans located in said vents.

9. Air quality control system according to claim 1, including exhaust vents located in said elevator shaft, said exhaust vents communicating with said exhaust duct.

10. Air quality control system according to claim 1, wherein each of said air inlet ducts draw fresh air directly from the outside of the building.

11. Air quality control system according to claim 1, including a main air handler duct drawing fresh air from the outside of the building, each of said air inlet ducts communicating with said main air handler duct.

12. Air quality control system according to claim 1, including doors connecting the public corridor with the units, said doors being equipped with means for automatically closing said doors.

13. The air quality control system according to claim 1, including an exhaust fan disposed in said exhaust duct for drawing off air from said zones.

14. The air quality control system according to claim 13, wherein said directing means are in the form of switches connected to said blower fans and said exhaust fan.

15. Air quality control system for multi-story apartment buildings with apartments, public corridors and an elevator shaft, comprising means for partitioning the public corridors into zones, said zones each having a first end in the vicinity of said partitioning means and a second end, air inlet ducts disposed in the vicinity of said second ends of each of said zones, blower fans disposed in said air inlet ducts for supplying fresh air to said zones, an exhaust duct communicating with each of said first ends of each of said zones for removing air form said zones, and means for directing an air flow from said air inlet ducts into the corridor and out of the corridor through said exhaust duct in dependence on the air quality in the corridor.

16. Air quality control system for buildings with units, public corridors and an elevator shaft, comprising means for partitioning the public corridors into zones, said zones each having a first end in the vicinity of said partitioning means and a second end, air inlet ducts disposed in the vicinity of said first ends of each of said zones, blower fans disposed in said air inlet ducts for supplying fresh air to said zones, an exhaust duct communicating with each of said second ends of each of said zones for removing stale or hot air form said zones, and means for directing an air flow form said air inlet ducts into the corridor and out of the corridor through said exhaust duct in dependence on the air quality in the corridor.

* * * * *